US007547191B2

(12) United States Patent
Liang

(10) Patent No.: US 7,547,191 B2
(45) Date of Patent: Jun. 16, 2009

(54) TURBINE AIRFOIL COOLING SYSTEM WITH PERIMETER COOLING AND RIM CAVITY PURGE CHANNELS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 397 days.

(21) Appl. No.: 11/509,230

(22) Filed: Aug. 24, 2006

(65) Prior Publication Data

US 2008/0050242 A1 Feb. 28, 2008

(51) Int. Cl.
*F01D 5/18* (2006.01)

(52) U.S. Cl. ..... 416/97 R

(58) Field of Classification Search ..... 415/115; 416/97 R, 96 R

See application file for complete search history.

(56) References Cited

U.S. PATENT DOCUMENTS

| | | | | |
|---|---|---|---|---|
| 4,073,599 | A | 2/1978 | Allen et al. | |
| 4,136,516 | A * | 1/1979 | Corsmeier | 60/39.091 |
| 4,775,296 | A | 10/1988 | Schwarzmann et al. | |
| 5,253,976 | A | 10/1993 | Cunha | |
| 5,403,159 | A | 4/1995 | Green et al. | |
| 5,601,399 | A | 2/1997 | Okpara et al. | |
| 5,772,397 | A | 6/1998 | Morris et al. | |
| 5,915,923 | A * | 6/1999 | Tomita et al. | 416/96 R |
| 5,975,850 | A | 11/1999 | Abuaf et al. | |
| 6,019,579 | A | 2/2000 | Fukuno et al. | |
| 6,036,440 | A | 3/2000 | Tomita et al. | |
| 6,142,734 | A | 11/2000 | Lee | |
| 6,241,467 | B1 | 6/2001 | Zelesky et al. | |
| 6,254,333 | B1 | 7/2001 | Merry | |
| 6,257,830 | B1 * | 7/2001 | Matsuura et al. | 416/96 R |
| 6,595,748 | B2 | 7/2003 | Flodman et al. | |
| 6,672,836 | B2 | 1/2004 | Merry | |
| 6,872,047 | B2 | 3/2005 | Tanioka | |
| 6,974,308 | B2 | 12/2005 | Halfmann et al. | |

* cited by examiner

*Primary Examiner*—Ninh H Nguyen

(57) ABSTRACT

A cooling system for a turbine airfoil of a turbine engine having a perimeter cooling channel formed from a portion of a serpentine cooling channel, an airfoil tip cooling channel, and a leading edge cooling channel. The cooling system also includes cooling channels enabling cooling fluids to be discharged into the root of the airfoil to cool rim cavities and purge air therein. The cooling system may be configured such that the cooling fluids may pass into a mid-chord serpentine cooling channel, flow through the serpentine cooling channel generally in a chordwise direction from the leading edge toward the trailing edge, flow toward the tip section and along the trailing edge, flow from the trailing edge toward the leading edge in the airfoil tip cooling channel, flow along the leading edge in the leading edge cooling channel, through the root of the blade, and be exhausted into a rim cavity.

20 Claims, 5 Drawing Sheets

TURBINE AIRFOIL COOLING SYSTEM WITH PERIMETER COOLING AND RIM CAVITY PURGE CHANNELS

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Thus, a need exists for a cooling system capable of providing sufficient cooling to turbine airfoils.

SUMMARY OF THE INVENTION

This invention relates to a cooling system for turbine airfoils used in turbine engines. In particular, the turbine airfoil cooling system may include an internal cavity positioned between outer walls of the turbine airfoil. The cooling system may also include a perimeter cooling system configured to pass cooling fluids in close proximity to a leading edge, an airfoil tip section, and a trailing edge before exhausting the cooling fluids into a root of the airfoil and into a rim cavity. Such a configuration utilizes rim cavity purge air for cooling the airfoil first and then directs the air to the rim cavity outside of the airfoil to provide cooling to the components forming the rim cavity and to prevent hot gas ingestion into the rim cavity, thereby improving turbine stage performance.

The cooling system may be installed in a generally elongated, hollow airfoil having a leading edge, a trailing edge, a tip section at a first end, and a root coupled to the airfoil at an end generally opposite the first end for supporting the airfoil and for coupling the airfoil to a disc. The cooling system is formed from at least one cavity in the elongated, hollow airfoil. In one embodiment, the cavity may be formed from a mid-chord serpentine cooling channel positioned in a mid-chord region of the generally elongated airfoil and formed from a first leg, a second leg, and a third leg. The legs may be generally aligned with each other. The first leg may be positioned between the trailing edge of the generally elongated airfoil and the second leg. In one embodiment, an outer wall of the airfoil may form an upstream portion of the third leg and the leading edge of the airfoil. The cooling system may also include a cooling supply channel in fluid communication with the first leg for supplying cooling fluids to the first leg from the root. The cooling system may also include an airfoil tip cooling channel in fluid communication with the third leg of the serpentine cooling channel and extending proximate to an outer wall forming the tip section of the airfoil. The cooling system may include a trailing edge cooling channel in fluid communication with the airfoil tip cooling channel and extending along the trailing edge of the generally elongated airfoil and into the root of the airfoil to exhaust cooling fluids into the root of the generally elongated airfoil and into an aft rim cavity. In one embodiment, a single rib may extend from a pressure side to a suction side of the generally elongated airfoil and separate the trailing edge cooling channel from the first leg of-the serpentine cooling channel.

The cooling system may also include one or more forward rim cooling channels in fluid communication with the serpentine cooling channel. The forward rim cooling channel may be in fluid communication with a serpentine cooling channel turn coupling the second leg of the serpentine cooling channel to the third leg of the serpentine cooling channel. The forward rim cooling channel may form an opening in an outer surface of the root of the generally elongated airfoil. The cooling system may also include one or more trailing edge exhaust orifices in fluid communication with the trailing edge cooling channel and forming at least one cooling fluid exhaust orifice in the trailing edge of the generally elongated airfoil. In one embodiment, there may be a plurality of trailing edge exhaust orifices positioned generally at acute angles relative to the trailing edge cooling channel and pointed toward the tip section of the generally elongated airfoil. The cooling system may also include one or more tip exhaust orifices in fluid communication with the airfoil tip cooling channel and forming one or more cooling fluid exhaust orifices in the tip section of the generally elongated airfoil. In one embodiment, there may be a plurality of tip exhaust orifices positioned generally at acute angle relative to the airfoil tip cooling channel and pointed in a downstream direction.

The cooling system may include one or more trip strips in the serpentine cooling channel, the airfoil tip cooling channel, or the trailing edge cooling channel, or in any combination thereof. The trip strips may protrude from an outer wall forming the pressure side of the generally elongated airfoil or from an outer wall forming the suction side, or both.

In another embodiment, the configuration of the cooling system may be reversed such that the cooling fluids may flow from the trailing edge toward the leading edge in the legs of the mid-chord serpentine cooling channel. The legs may be positioned such that the cooling fluids flowing through the legs go from proximate to the trailing edge to the leading edge. The cooling system may include a cooling channel at the tip section of the turbine blade and a trailing edge cooling channel that exhausts cooling fluids from the blade, through the root, and out of an orifice into an aft rim cavity. Cooling fluids may also be exhausted from a forward rim cooling channel.

An advantage of this invention is that the perimeter cooling system of the cooling system utilizes rim cavity purge air to first cool the airfoil. In particular, the rim cavity purge air may first be passed into the mid-chord serpentine cooling channel, the airfoil tip cooling channel, the trailing edge cooling channel, and passed out of the root of the airfoil and into a rim cavity. The double use of the rim cavity purge air improves the turbine stage performance.

Another advantage of the invention is that the location of the airfoil tip cooling channel creates impingement cooling at a trailing edge corner of the tip section of the airfoil, which enhances the airfoil tip corner cooling.

Yet another advantage of this invention is that the cooling system is designed as a counterflow system in which cooling fluids travel around the perimeter of the airfoil from the trailing edge to the leading edge. Such a configuration yields a lower thermal gradient for the internal partition ribs forming the cooling channels of the cooling system.

Another advantage of this invention is that the root discharge openings provide additional support to the serpentine ceramic core during casting, which translates into improved production yields of the airfoil.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
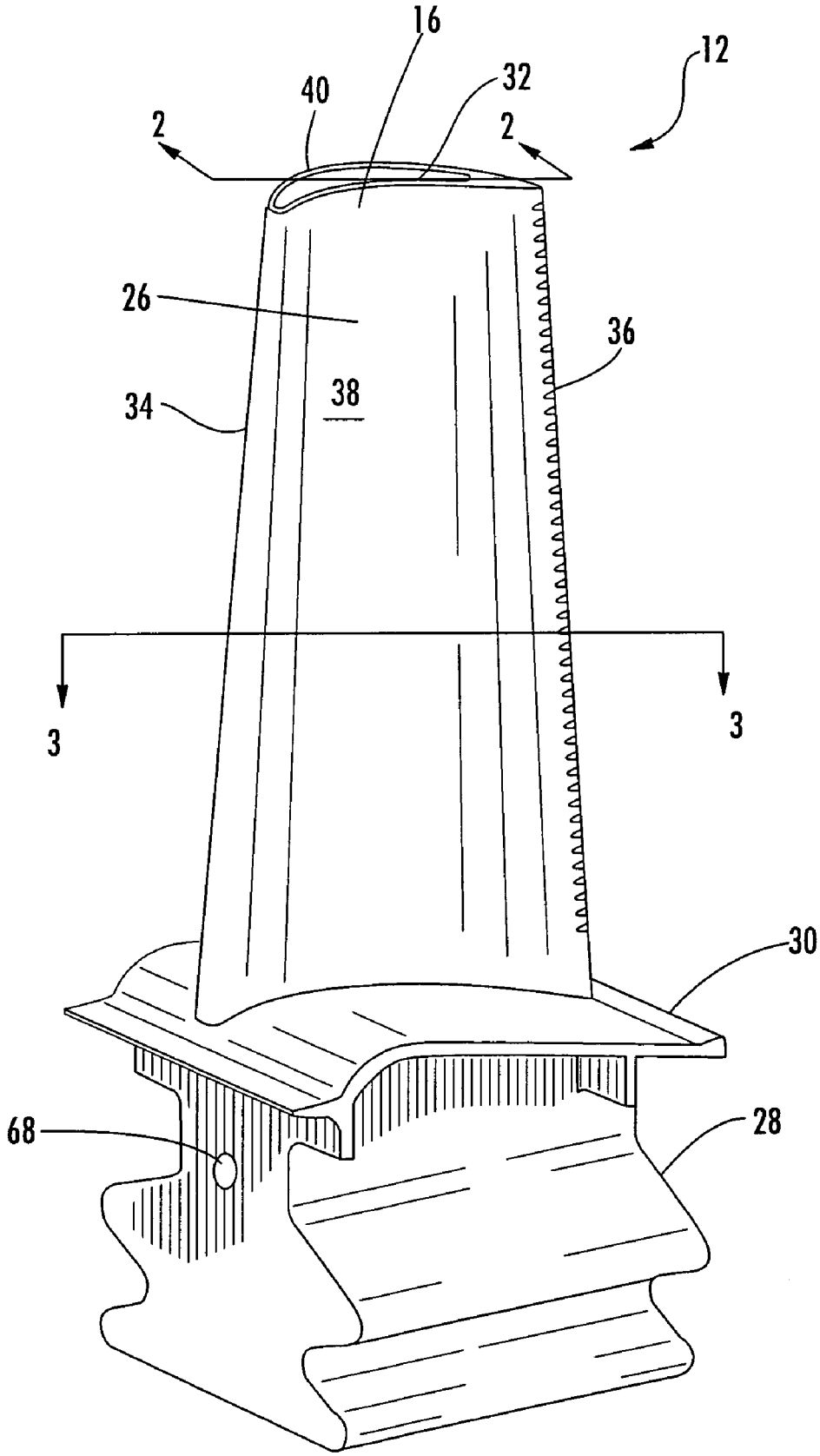
FIG. 1 is a perspective view of a turbine airfoil having features according to the instant invention.
Figure 2:
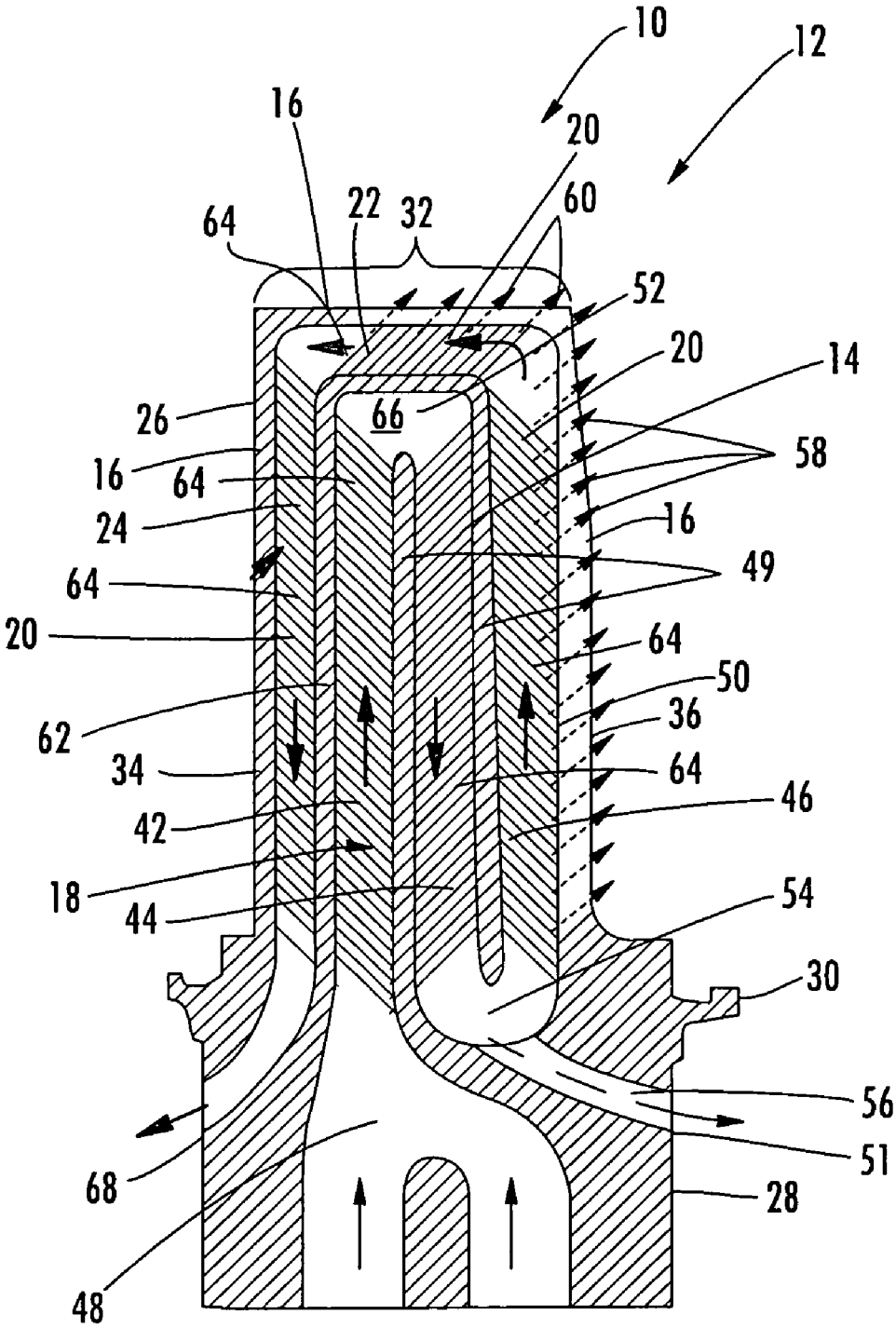
FIG. 2 is a cross-sectional view, commonly referred to as a filleted view, of the turbine airfoil shown in FIG. 1 taken along line 2-2.
Figure 3:
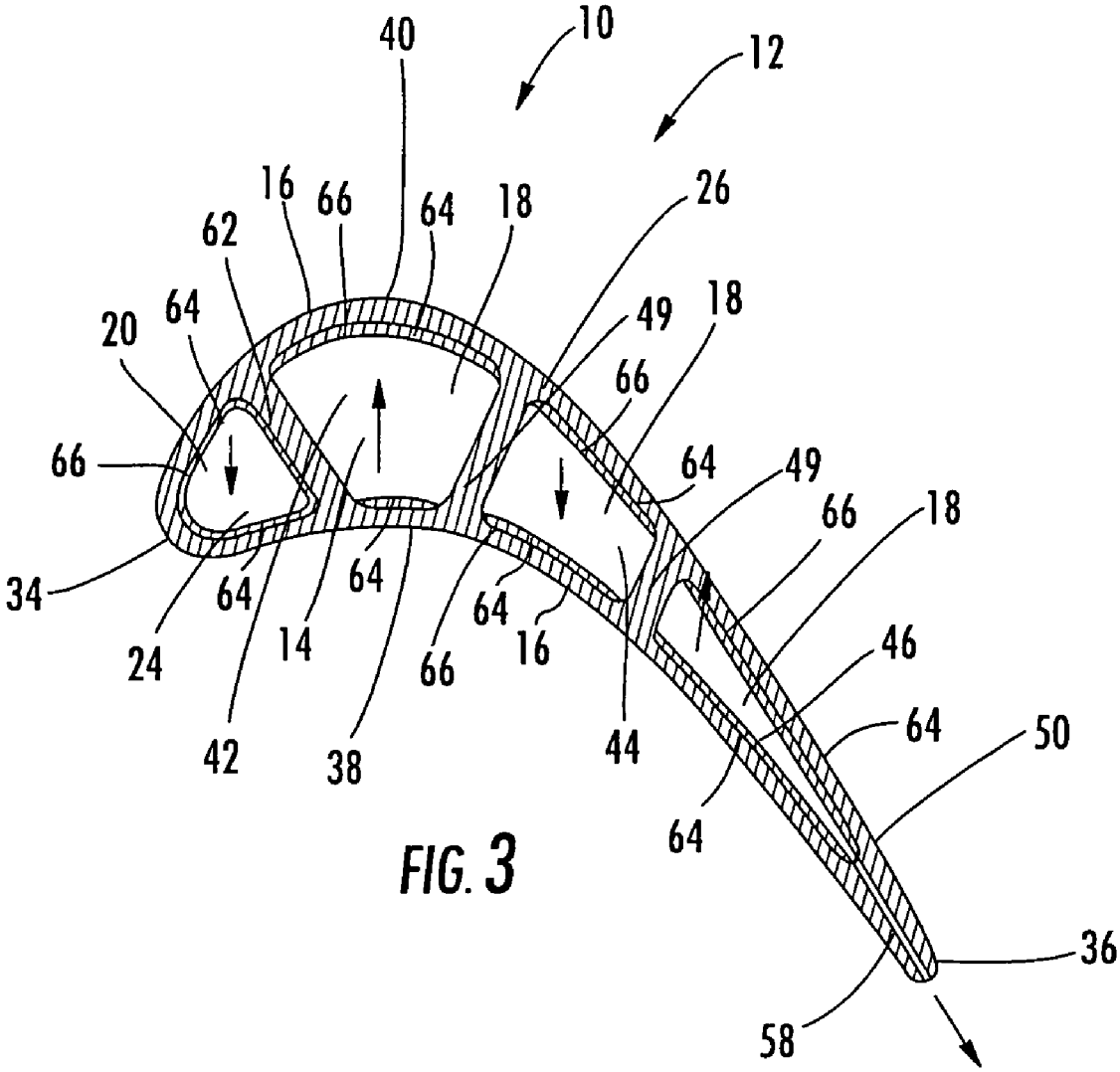
FIG. 3 is a detailed cross-sectional view of a portion of the vortex cooling chambers shown in FIG. 1 along line 3-3.

As shown in FIGS. 1-5, this invention is directed to a turbine airfoil cooling system 10 for a turbine airfoil 12 used in turbine engines. In particular, the turbine airfoil cooling system 10 includes a plurality of internal cavities 14, as shown in FIG. 3, positioned between outer walls 16 of the turbine airfoil 12. The cavity 14 may be formed from a mid-chord serpentine cooling channel 18 in fluid communication with a perimeter cooling system 20. The perimeter cooling system 20 may be formed from an airfoil tip cooling channel 22 and a third leg 24. The perimeter cooling system 20 may exhaust at least a portion of the cooling fluids from the airfoil 12 through cooling channels in a root 28 of the airfoil 12.

The turbine airfoil 12 may be formed from a generally elongated, hollow airfoil 26 coupled to the root 28 at a platform 30. The turbine airfoil 12 may be formed from conventional metals or other acceptable materials. The generally elongated airfoil 26 may extend from the root 28 to a tip section 32 and include a leading edge 34 and trailing edge 36. Airfoil 26 may have an outer wall 16 adapted for use, for example, in a first stage of an axial flow turbine engine. Outer wall 16 may form a generally concave shaped portion forming pressure side 38 and may form a generally convex shaped portion forming suction side 40. The cavity 14, as shown in FIG. 3, may be positioned in inner aspects of the airfoil 26 for directing one or more gases, which may include air received from a compressor (not shown), through the airfoil 26 to reduce the temperature of the airfoil 26.

The cooling system 10, as shown in FIGS. 1-3, may include a mid-chord serpentine cooling channel 18 forming the internal cavity 14. The mid-chord serpentine cooling channel 18 may be formed from a first leg 42, a second leg 44, and a third leg 46. The legs 42, 44, 46 may be formed with internal ribs 49. The legs 42, 44, 46 may extend from an outer wall 16 forming the pressure side 38 to an outer wall 16 forming a suction side 40. In other embodiments, the serpentine cooling channel 18 may be formed from more or less number of legs. The serpentine cooling channel 18 may extend from close proximity of the tip section 32 of the airfoil 26 to the root 28. In other embodiments, the serpentine cooling chamber 18 may have a shorter length. The serpentine cooling chamber 18 may be in fluid communication with one or more cooling fluid supply channels 48 in the root 28. In particular, the first leg 42 may be in fluid communication with the supply channels such that cooling fluids flow radially from the root 28 toward the tip section 32. The serpentine cooling chamber 18 may be positioned such that the first leg 42 extends in a generally spanwise direction and is positioned between the leading edge and the second leg 44. In at least one embodiment, the first, second, and third legs 42, 44, 46 may be aligned with each other and may be positioned in a generally spanwise direction. The second leg 44 may be positioned between the first and third legs 42, 46 and may direct cooling fluids from proximate the tip section 32 toward the root 28. The third leg 46 may be positioned between the second leg 44 and the trailing edge 36. In at least one embodiment, a downstream side 50 of the third leg 46 may be formed from the outer wall 16 forming the trailing edge 36. The first and second legs 42, 44 may be in fluid communication with each other through a first turn 52, and the second and third legs 44, 46 may be in fluid communication with each other through a second turn 54.

The cooling system 10 may also include one or more aft rim cooling channels 56 in fluid communication with the mid-chord serpentine cooling channel 18. In particular, the aft rim cooling channel 56 may be in communication with the second turn 54. The aft rim cooling channel 56 may exhaust the cooling fluids from the cooling system 10 through an opening 51 the root 28.

The cooling system 10 may also include an airfoil tip cooling channel 22 positioned proximate to the tip section 32 between the tip section 32 and the mid-chord serpentine cooling channel 18. The airfoil tip cooling channel 22 may be in fluid communication with the third leg 46. The airfoil tip cooling channel 22 may extend generally spanwise from the trailing edge 36 to the leading edge 34. In one embodiment, the outer wall 16 forming the tip section 32 may also form an outer side of the airfoil tip cooling channel 22.

The cooling system 10 may include a one or more trailing edge exhaust orifices 58 extending through the outer wall 16 forming the trailing edge 36. The trailing edge exhaust orifices 58 may create a fluid pathway through the outer wall 16 from the third leg 46. The trailing edge exhaust orifices 58 may be positioned at an acute angle relative to the third leg 46 and may be pointed toward the tip section 32 of the generally elongated airfoil 26. In other embodiments, the trailing edge exhaust orifices 32 may be positioned at other angles.

One or more tip exhaust orifices 60 may be positioned in the outer wall 16 forming the tip section 32. The exhaust orifices 60 may create a fluid pathway through the outer wall 16 from the airfoil tip cooling channel 22. The tip exhaust orifices 60 may be positioned at an acute angle relative to the airfoil tip cooling channel 22 and may be pointed downstream toward the trailing edge 36. In other embodiments, the tip exhaust orifices 60 may be positioned at other angles.

The cooling system 10 may also include a leading edge cooling channel 24. The leading edge cooling channel 24 may be in fluid communication with the airfoil tip cooling channel 22 and may extend spanwise along the leading edge 34 of the airfoil 26. The leading edge cooling channel 24 may extend into the root 28 of the airfoil 26 to exhaust cooling fluids into the root 28. The leading edge cooling channel 24 may forming an opening 68 in the root 28. In one embodiment, a single rib 62 may extend from the pressure side 38 to the suction side 40 of the generally elongated airfoil 26 to separate the leading edge cooling channel 24 from the first leg 42 of the serpentine cooling channel 18.

The cooling system 10 may include one or more trip strips 64 for increasing the cooling capacity of the system 10. In at least one embodiment, the trip strips 64 may be positioned on inner surfaces 66 of the mid-chord serpentine cooling channel 18, the airfoil tip cooling channel 22, the leading edge cooling channel 24, or the aft rim cooling channel 56, or any combination thereof. The trips strips 64 may be positioned on the pressure side 38 or the suction side 40 of the cooling channels or both. The trip strips 64 may be positioned orthogonal to the flow of the cooling fluids through the cooling channels or may be positioned at an angle, as shown in FIG. 2.

During use, cooling fluids may flow into the cooling system 10 from a cooling fluid supply source (not shown). In particular, the cooling system 10 may be configured to use rim cooling and purge air to first cooling the airfoil 26. For example, the cooling system 10 may receive cooling fluids from a cool fluid source and direct the cooling fluids into the first leg 42 of the mid-chord serpentine cooling channel 18, wherein the cooling fluids flow radially outward in the airfoil 26. The cooling fluids may flow through the first turn 52 and into the second leg 44, where the fluids flow radially inward. The cooling fluids may then flow though the second turn 54 and flow radially outward in the third leg 46. At least a portion of the cooling fluids may flow into the aft rim cooling channel 56. In addition, a portion of the cooling fluids may be released from the cooling system 10 through the trailing edge exhaust orifices 58 positioned in the trailing edge 36. The cooling fluids may flow in the third leg 46 to the airfoil tip section 32 and turn toward the leading edge 34. The cooling fluids may flow into the airfoil tip cooling channel 22. The cooling fluids may then flow spanwise from the trailing edge 36 to the leading edge 34. A portion of the cooling fluids may be exhausted through the tip exhaust orifices 60. The cooling fluids may then flow radially inward in the leading edge cooling channel 24. The cooling fluids may be exhausted into the root 28 and out opening 68 for rim cavity cooling and purging.

Figure 4:
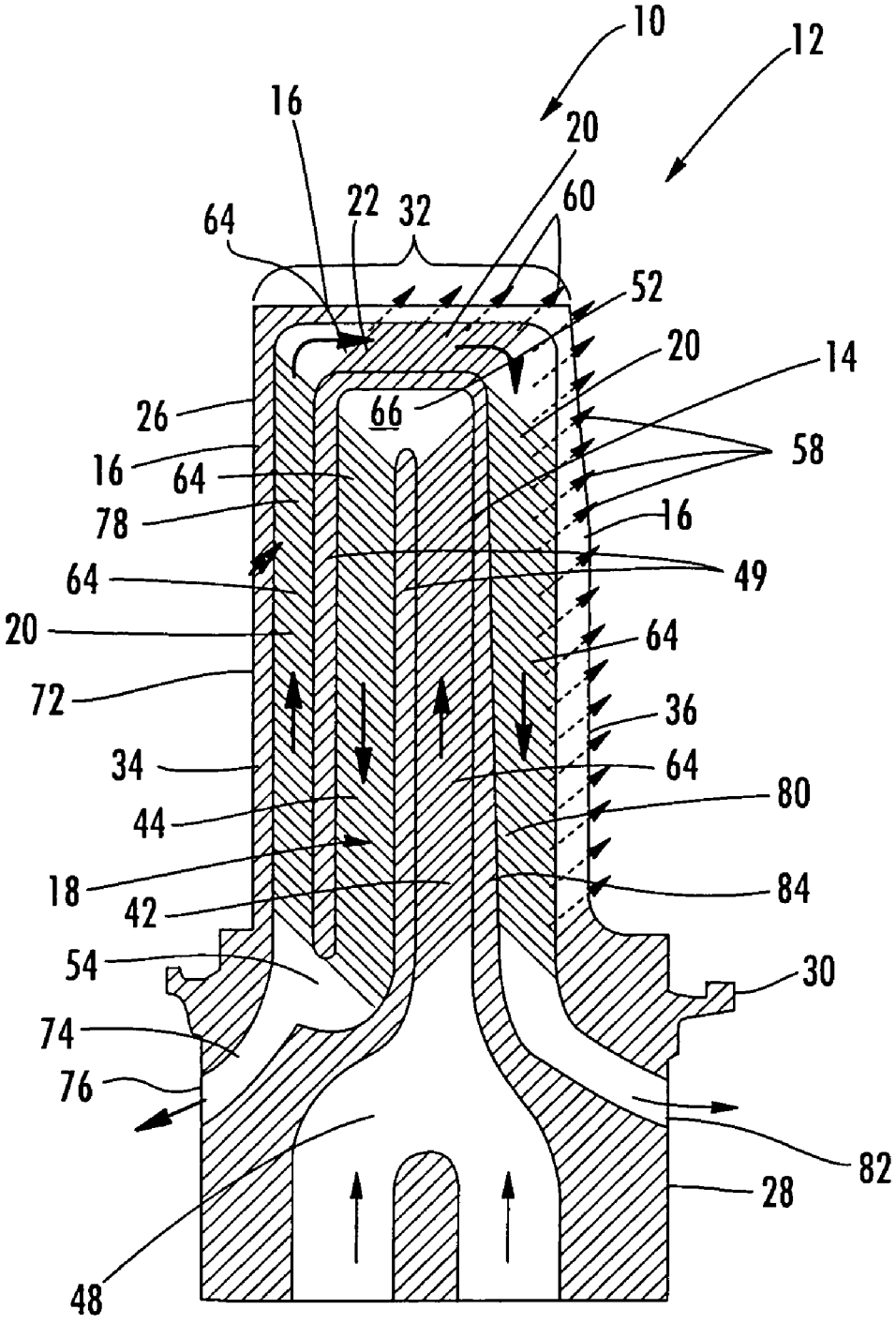
FIG. 4 is a cross-sectional view of the turbine airfoil with an alternative configuration of a cooling system shown in FIG. 1 taken along line 2-2.
Figure 5:
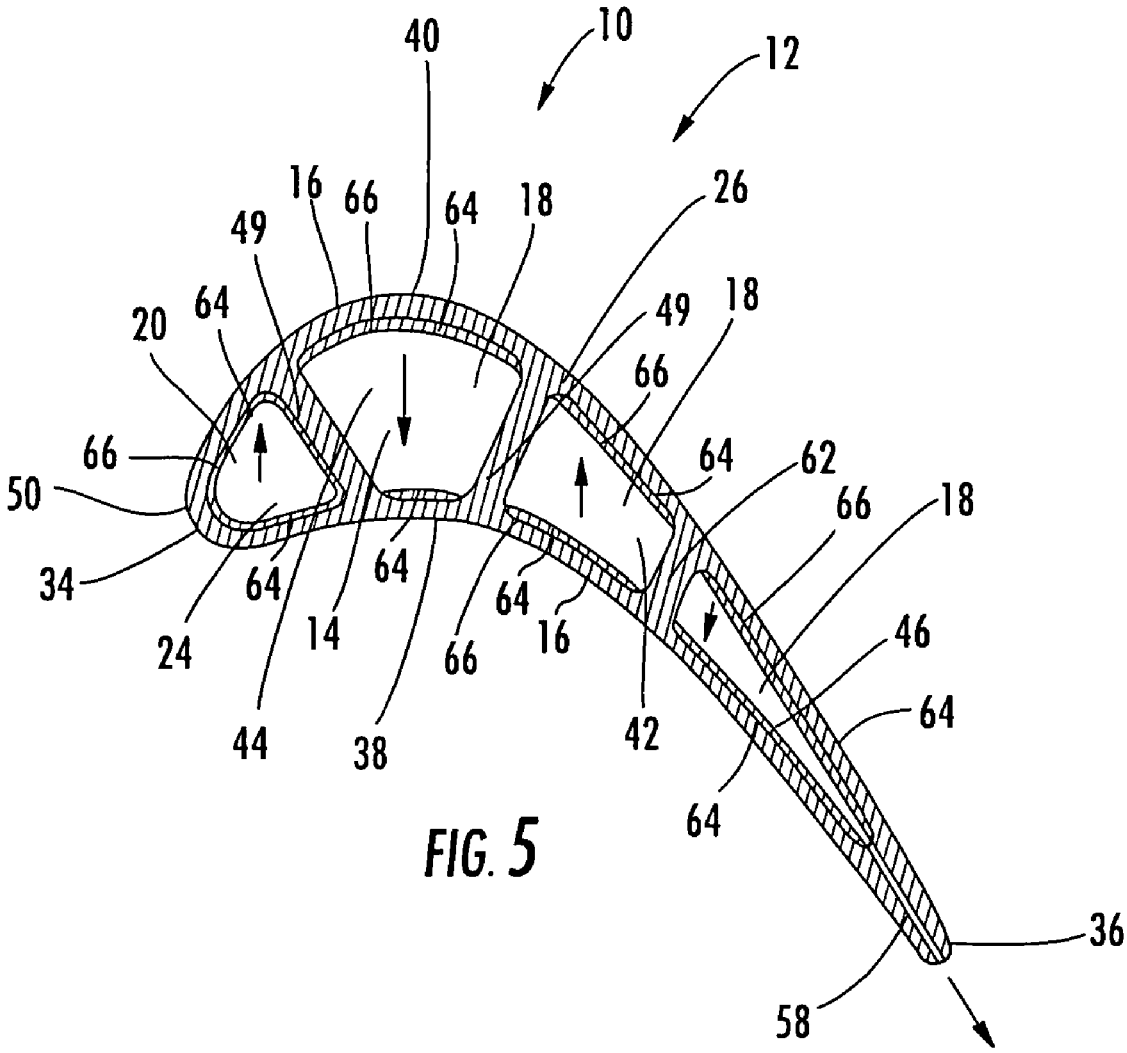
FIG. 5 is a detailed cross-sectional view of the alternative configuration shown in FIG. 4.

In another embodiment, as shown in FIGS. 4-5, the cooling system 10, may include a mid-chord serpentine cooling channel 18 formed from a first leg 42, a second leg 44, and a third leg 46. The cooling system 10 shown in this embodiment in FIG. 4 and 5 may be substantially similar to the embodiment shown in FIGS. 2-3, except for the following described differences. The legs 42, 44, 46 may be positioned such that the cooling fluids flowing through the legs go from proximate to the trailing edge 36 to the leading edge 34. The serpentine cooling chamber 18 may be positioned such that the first leg 42 extends in a generally spanwise direction and is positioned between the trailing edge 36 and the second leg 44. The first, second, and third legs 42, 44, 78 may be aligned with each other and may be positioned in a generally spanwise direction. The second leg 44 may be positioned between the first and third legs 42, 78 and may direct cooling fluids from proximate the tip section 32 toward the root 28. The third leg 78 may be positioned between the second leg 44 and the leading edge 34. In at least one embodiment, an upstream side 72 of the third leg 78 may be formed from the outer wall 16 forming the leading edge 34. The first and second legs 42, 44 may be in fluid communication with each other through a first turn 52, and the second and third legs 44, 78 may be in fluid communication with each other through a second turn 54.

As shown in FIG. 4, the cooling system 10 may also include one or more forward rim cooling channels 74 in fluid communication with the second root turn 54. The forward rim cooling channel 56 may exhaust the cooling fluids from the cooling system 10 through an opening 76 the root 28.

The cooling system 10 may also include an airfoil tip cooling channel 22 positioned proximate to the tip, section 32 between the tip section 32 and the mid-chord serpentine cooling channel 18 and extending generally spanwise from the trailing edge 36 to the leading edge 34. In one embodiment, the outer wall 16 forming the tip section 32 may also form an outer side of the airfoil tip cooling channel 22.

The cooling system 10 may also include a trailing edge cooling channel 80. The trailing edge cooling channel 80 may be in fluid communication with the airfoil tip cooling channel 22 and may extend spanwise along the trailing edge 36 of the airfoil 26. The trailing edge cooling channel 80 may extend into the root 28 of the airfoil 26 to exhaust cooling fluids into the root 28 and into an aft rim cavity. The trailing edge cooling channel 80 may form an opening 82 in the root 28. In one embodiment, a single rib 84 may extend from the pressure side 38 to the suction side 40 of the generally elongated airfoil 26 to separate the trailing edge cooling channel 80 from the first leg 42 of the serpentine cooling channel 18.

During use, cooling fluids may flow into the cooling system 10 from a cooling fluid supply source (not shown). In particular, the cooling system 10 may be configured to use rim cooling and purge air to first cool the airfoil 26. For example, the cooling system 10 may receive cooling fluids from a cool fluid source and direct the cooling fluids into the first leg 42 of the mid-chord serpentine cooling channel 18, wherein the cooling fluids flow radially outward in the airfoil 26. The cooling fluids may flow through the first turn 52 and into the second leg 44, where the fluids flow radially inward. The cooling fluids may then flow though the second turn 54 and flow radially outward in the third leg 78 at the leading edge 34. At least a portion of the cooling fluids may flow into the forward rim cooling channel 56. The cooling fluids may flow in the third leg 78 to the airfoil tip section 32 and turn toward the trailing edge 36. The cooling fluids may flow into the airfoil tip cooling channel 22. The cooling fluids may then flow spanwise from the leading edge 34 to the trailing edge 36. A portion of the cooling fluids may be exhausted through the tip exhaust orifices 60. The cooling fluids may then flow radially inward in the trailing edge cooling channel 80. In addition, a portion of the cooling fluids may be released from the cooling system 10 through the trailing edge exhaust orifices 58 positioned in the trailing edge 36. The cooling fluids may be exhausted into the root 28 and out opening 82 for rim cavity cooling and purging.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated, hollow airfoil having a leading edge, a trailing edge, a tip section at a first end, a root coupled to the airfoil at an end generally opposite to the first end for supporting the airfoil and for coupling the airfoil to a disc, and a cooling system formed from at least one cavity in the elongated, hollow airfoil;

the cooling system comprising a serpentine cooling channel positioned in a mid-chord region of the generally elongated airfoil and being formed from a first leg, a second leg, and a third leg wherein the legs are generally aligned with each other and the first leg is positioned between the leading edge of the generally elongated airfoil and the second leg;

a cooling supply channel in fluid communication with the first leg for supplying cooling fluids to the first leg from the root;

an airfoil tip cooling channel in fluid communication with the third leg of the serpentine cooling channel and extending proximate to an outer wall forming the tip section of the airfoil;

a leading edge cooling channel in fluid communication with the airfoil tip cooling channel and extending along the leading edge of the generally elongated airfoil and into the root of the airfoil to exhaust cooling fluids into the root of the generally elongated airfoil.

2. The turbine airfoil of claim 1, further comprising at least one aft rim cooling channel in fluid communication with the serpentine cooling channel.

3. The turbine airfoil of claim 2, wherein the at least one aft rim cooling channel is in fluid communication with a serpentine cooling channel turn coupling the second leg of the serpentine cooling channel to the third leg of the serpentine cooling channel.

4. The turbine airfoil of claim 3, wherein the at least one aft rim cooling channel forms an opening in an outer surface of the root of the generally elongated airfoil.

5. The turbine airfoil of claim 1, further comprising at least one trailing edge exhaust orifice in fluid communication with the third leg of the serpentine cooling channel and forming at least one cooling fluid exhaust orifice in the trailing edge of the generally elongated airfoil.

6. The turbine airfoil of claim 5, wherein the at least one trailing edge exhaust orifice comprises a plurality of trailing edge exhaust orifices positioned generally at acute angles relative to the third leg of the serpentine cooling channel and pointed toward the tip section of the generally elongated airfoil.

7. The turbine airfoil of claim 1, further comprising at least one tip exhaust orifice in fluid communication with the airfoil tip cooling channel and forming at least one cooling fluid exhaust orifice in the tip section of the generally elongated airfoil.

8. The turbine airfoil of claim 7, wherein the at least one tip exhaust orifice comprises a plurality of tip exhaust orifices positioned generally at acute angle relative to the airfoil tip cooling channel and pointed in a downstream direction.

9. The turbine airfoil of claim 8, further comprising at least one trip strip in at least one of the group consisting of the serpentine cooling channel, the airfoil tip cooling channel, and the leading edge cooling channel.

10. The turbine airfoil of claim 9, wherein the at least one trip strip protrudes from an outer wall forming a pressure side of the generally elongated airfoil.

11. The turbine airfoil of claim 10, wherein the at least one trip strip comprises a plurality of trip strips protruding from the outer walls forming the pressure side and a suction side of the generally elongated airfoil.

12. The turbine airfoil of claim 1, wherein a single rib extends from a pressure side to a suction side of the generally elongated airfoil and separates the leading edge cooling channel from the first leg of the serpentine cooling channel.

13. The turbine airfoil of claim 1, wherein an outer wall of the generally elongated airfoil forms a downstream side of the third leg of the serpentine cooling channel and forms the trailing edge of the generally elongated airfoil.

14. A turbine airfoil, comprising:

a generally elongated, hollow airfoil having a leading edge, a trailing edge, a tip section at a first end, a root coupled to the airfoil at an end generally opposite to the first end for supporting the airfoil and for coupling the airfoil to a disc, and a cooling system formed from at least one cavity in the elongated, hollow airfoil;

the cooling system comprising a serpentine cooling channel positioned in a mid-chord region of the generally elongated airfoil and being formed from a first leg, a second leg, and a third leg wherein the legs are generally aligned with each other and the first leg is positioned between the trailing edge of the generally elongated airfoil and the second leg;

a cooling supply channel in fluid communication with the first leg for supplying cooling fluids to the first leg from the root;

an airfoil tip cooling channel in fluid communication with the third leg of the serpentine cooling channel and extending proximate to an outer wall forming the tip section of the airfoil;

a trailing edge cooling channel in fluid communication with the airfoil tip cooling channel and extending along the trailing edge of the generally elongated airfoil and into the root of the airfoil to exhaust cooling fluids into the root of the generally elongated airfoil and into an aft rim cavity;

wherein an outer wall of the generally elongated airfoil forms a downstream side of the third leg of the serpentine cooling channel and forms the trailing edge of the generally elongated airfoil; and wherein the outer wall of the generally elongated airfoil forms the tip section and an outer side of the airfoil tip cooling channel.

15. The turbine airfoil of claim 14, further comprising at least one forward rim cooling channel in fluid communication with the serpentine cooling channel.

16. The turbine airfoil of claim 15, wherein the at least one forward rim cooling channel is in fluid communication with a serpentine cooling channel turn coupling the second leg of the serpentine cooling channel to the third leg of the serpentine cooling channel.

17. The turbine airfoil of claim 14, further comprising a plurality of trailing edge exhaust orifices positioned generally at acute angles relative to the trailing edge cooling channel of the serpentine cooling channel and pointed toward the tip section of the generally elongated airfoil.

18. The turbine airfoil of claim 14, further comprising a plurality of tip exhaust orifices positioned generally at acute angles relative to the airfoil tip cooling channel and pointed in a downstream direction.

19. The turbine airfoil of claim 18, further comprising at least one trip strip extending from an inner surface of a pressure side and an inner surface in a suction side in at least one of the group consisting of the serpentine cooling channel, the airfoil tip cooling channel, and the trailing edge cooling channel.

20. The turbine airfoil of claim 14, wherein a single rib extending from a pressure side to a suction side of the generally elongated airfoil separates the trailing edge cooling channel from the first leg of the serpentine cooling channel.

* * * * *